US011225706B2

(12) United States Patent
Takatani et al.

(10) Patent No.: US 11,225,706 B2
(45) Date of Patent: Jan. 18, 2022

(54) GRAIN-ORIENTED ELECTRICAL STEEL SHEET

(71) Applicant: NIPPON STEEL CORPORATION, Tokyo (JP)

(72) Inventors: Shinsuke Takatani, Tokyo (JP); Kenichi Murakami, Tokyo (JP); Yoshiyuki Ushigami, Tokyo (JP); Shunsuke Okumura, Tokyo (JP); Shohji Nagano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 190 days.

(21) Appl. No.: 16/629,275

(22) PCT Filed: Jul. 13, 2018

(86) PCT No.: PCT/JP2018/026621
§ 371 (c)(1),
(2) Date: Jan. 7, 2020

(87) PCT Pub. No.: WO2019/013352
PCT Pub. Date: Jan. 17, 2019

(65) Prior Publication Data

US 2020/0190644 A1 Jun. 18, 2020

(30) Foreign Application Priority Data

Jul. 13, 2017 (JP) ..... JP2017-137440

(51) Int. Cl.
*C22C 38/04* (2006.01)
*C22C 38/16* (2006.01)
(Continued)

(52) U.S. Cl.
CPC ..... *C22C 38/60* (2013.01); *C21D 6/008* (2013.01); *C21D 8/1222* (2013.01);
(Continued)

(58) Field of Classification Search
None
See application file for complete search history.

(56) References Cited

FOREIGN PATENT DOCUMENTS

EP 0 565 029 A1 10/1993
JP 48-39338 A 6/1973
(Continued)

OTHER PUBLICATIONS

International Search Report for PCT/JP2018/026621 (PCT/ISA/210) dated Sep. 25, 2018.
JIS R 6010: 2000, "Coated abrasive grain sizes", total of 25 pages.
Misao Morita, "Evaluation Method for Distinctness of Image of Coated Surface", Iron and Steel, vol. 77, No. 7, p. 1075 (1991), total of 24 pages.
(Continued)

*Primary Examiner* — Adam Krupicka
(74) *Attorney, Agent, or Firm* — Birch, Stewart, Kolasch & Birch, LLP

(57) ABSTRACT

A grain-oriented electrical steel sheet includes a steel sheet and an amorphous oxide layer that is formed on the steel sheet, in which the steel sheet includes, as a chemical composition, by mass %, C: 0.085% or less, Si: 0.80% to 7.00%, Mn: 1.50% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, and a NSIC value of a surface is 4.0% or more, the NSIC value being obtained by measuring an image clearness of the surface using an image clearness measuring device.

4 Claims, 1 Drawing Sheet

(51) Int. Cl.

| | |
|---|---|
| ***C22C 38/60*** | (2006.01) |
| ***C21D 6/00*** | (2006.01) |
| ***C21D 8/12*** | (2006.01) |
| ***C21D 9/46*** | (2006.01) |
| ***C22C 38/00*** | (2006.01) |
| ***C22C 38/06*** | (2006.01) |
| ***C22C 38/08*** | (2006.01) |

(52) U.S. Cl.

CPC ..... *C21D 8/1233* (2013.01); *C21D 8/1255* (2013.01); *C21D 8/1261* (2013.01); *C21D 8/1283* (2013.01); *C21D 9/46* (2013.01); *C22C 38/001* (2013.01); *C22C 38/002* (2013.01); *C22C 38/008* (2013.01); *C22C 38/04* (2013.01); *C22C 38/06* (2013.01); *C22C 38/08* (2013.01); *C22C 38/16* (2013.01); *C22C 2202/02* (2013.01)

(56) References Cited

FOREIGN PATENT DOCUMENTS

| | | | |
|---|---|---|---|
| JP | 6-184762 | A | 7/1994 |
| JP | 7-278670 | A | 10/1995 |
| JP | 7-278833 | A | 10/1995 |
| JP | 11-106827 | A | 4/1999 |
| JP | 11-118750 | A | 4/1999 |
| JP | 2002-322566 | A | 11/2002 |
| JP | 2002-348643 | A | 12/2002 |
| JP | 2002-363763 | A | 12/2002 |
| JP | 2003-268450 | A | 9/2003 |
| JP | 2003-293149 | A | 10/2003 |
| JP | 2003-313644 | A | 11/2003 |
| JP | 2009-228117 | A | 10/2009 |
| JP | 2010-40666 | A | 2/2010 |
| WO | WO 2010/013109 | A1 | 2/2010 |

OTHER PUBLICATIONS

Written Opinion of the International Searching Authority for PCT/JP2018/026621 (PCT/ISA/237) dated Sep. 25, 2018.

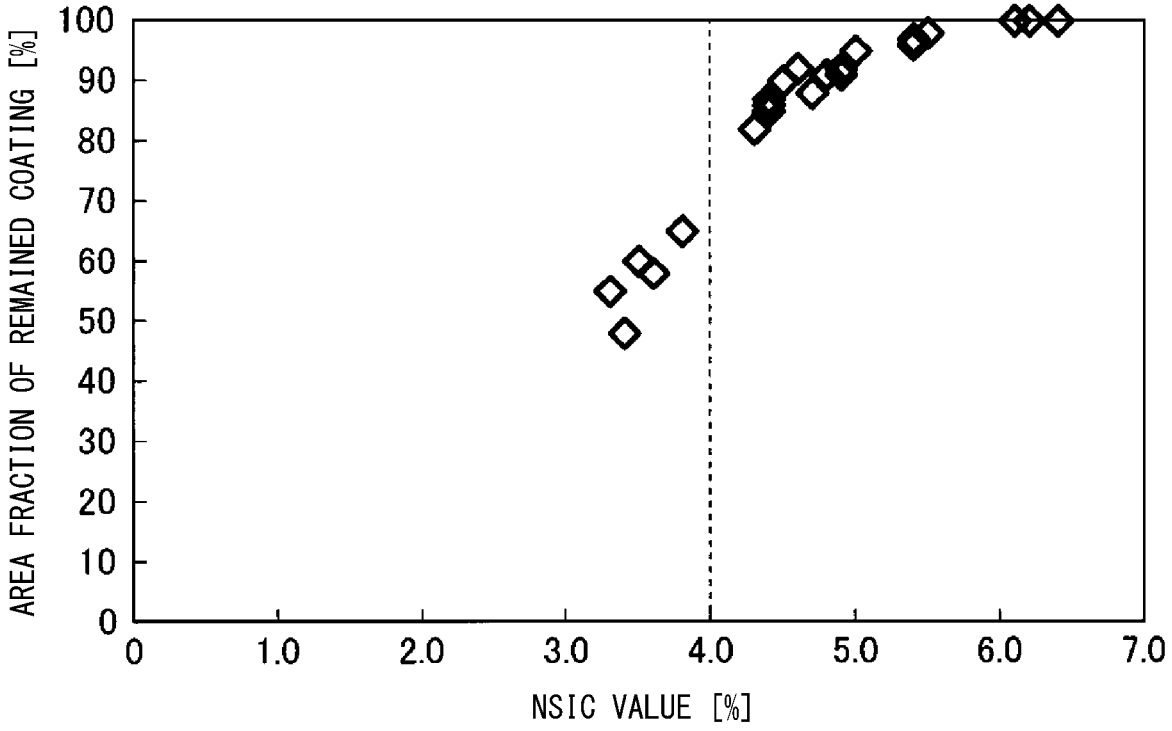
AREA FRACTION OF REMAINED COATING [%]
100
90
80
70
60
50
40
30
20
10
0
0
1.0
2.0
3.0
4.0
5.0
6.0
7.0
NSIC VALUE [%]

GRAIN-ORIENTED ELECTRICAL STEEL SHEET

TECHNICAL FIELD OF THE INVENTION

The present invention relates to a grain-oriented electrical steel sheet that is used as an iron core material of a transformer and particularly relates to a grain-oriented electrical steel sheet with an amorphous oxide layer having excellent adhesion with a tension-insulation coating.

Priority is claimed on Japanese Patent Application No. 2017-137440, filed on Jul. 13, 2017, the content of which is incorporated herein by reference.

RELATED ART

A grain-oriented electrical steel sheet is used mainly in a transformer. A transformer is continuously excited over a long period of time from installation to disuse such that energy loss continuously occurs. Therefore, energy loss occurring when the transformer is magnetized by an alternating current, that is, iron loss is a main parameter that determines the performance of the transformer.

In order to reduce iron loss of a grain-oriented electrical steel sheet, many methods, for example, a method of highly aligning grains in the {110}<001> orientation called Goss orientation, a method of increasing the content of a solid solution element such as Si that increases electric resistance, or a method of reducing the thickness of a steel sheet have been developed.

In addition, a method of applying tension to a steel sheet is effective for reducing iron loss. In order to apply tension to a steel sheet, it is effective to form a coating on a steel sheet surface at a high temperature using a material having a lower thermal expansion coefficient than the steel sheet. In a final annealing process, a forsterite film formed by a reaction of an oxide on a steel sheet surface and an annealing separator can apply tension to the steel sheet, and thus also has excellent coating adhesion.

For example, a method disclosed in Patent Document 1 in which an insulation coating is formed by baking a coating solution including colloidal silica and a phosphate as main components has a high effect of applying tension to a steel sheet and is effective for reducing iron loss. Accordingly, a method of forming an insulating coating including a phosphate as a main component in a state where a forsterite film formed in a final annealing process remains is a general method of manufacturing a grain-oriented electrical steel sheet.

On the other hand, it has been clarified that a domain wall motion is inhibited by the forsterite film and the forsterite film adversely affects iron loss. In a grain-oriented electrical steel sheet, a magnetic domain changes depending on a domain wall motion in an alternating magnetic field. In order to reduce iron loss, it is effective to smoothly perform the domain wall motion. However, the forsterite film has an uneven structure in a steel sheet/insulation coating interface. Therefore, the domain wall motion is inhibited by the forsterite film which adversely affects iron loss.

Accordingly, a technique of suppressing formation of a forsterite film and smoothing a steel sheet surface has been developed. For example, Patent Documents 2 to 5 disclose a technique of controlling an atmosphere dew point of decarburization annealing and using alumina as an annealing separator so as to smooth a steel sheet surface without forming a forsterite film after final annealing.

However, when a steel sheet surface is smoothed as described above, in order to apply tension to the steel sheet, it is necessary to form a tension-insulation coating having sufficient adhesion.

In order to solve this problem. Patent Document 6 discloses a method of forming a tension-insulation coating after forming an amorphous oxide layer on a steel sheet surface. In addition. Patent Documents 7 to 11 disclose a technique of controlling a structure of an amorphous oxide layer in order to form a tension-insulation coating having higher adhesion.

Patent Document 7 discloses a method of securing coating adhesion between a tension-insulation coating and a steel sheet. In this method, coating adhesion is secured by performing a pre-treatment on a smoothed steel sheet surface of a grain-oriented electrical steel sheet to introduce fine unevenness thereinto, forming an externally oxidized layer thereon, and forming an externally oxidized granular oxide including silica as a main component, which penetrates the thickness of the externally oxidized layer.

Patent Document 8 discloses a method of securing coating adhesion between a tension-insulation coating and a steel sheet. In this method, in a heat treatment process for forming an externally oxidized layer on a smoothed steel sheet surface of a grain-oriented electrical steel sheet, a temperature rising rate in a temperature range of 200° C. to 1150° C. is controlled to be 10° C./sec to 500° C./sec such that a cross-sectional area fraction of a metal oxide of iron, aluminum, titanium, manganese, or chromium, or the like in the externally oxidized layer is 50% or less. As a result, coating adhesion between the tension-insulation coating and the steel sheet is secured.

Patent Document 9 discloses a method of securing coating adhesion between a tension-insulation coating and a steel sheet. In this method, in a process of forming a tension-insulation coating after forming an externally oxidized layer on a smoothed steel sheet surface of a grain-oriented electrical steel sheet, a contact time between the steel sheet, on which the externally oxidized layer is formed and a coating solution for forming the tension-insulation coating is set to be 20 seconds or shorter such that a proportion of a low density layer in the externally oxidized layer is 30% or less. As a result, coating adhesion between the tension-insulation coating and the steel sheet is secured.

Patent Document 10 discloses a method of securing coating adhesion between a tension-insulation coating and a steel sheet. In this method, a heat treatment for forming an externally oxidized layer on a smoothed steel sheet surface of a grain-oriented electrical steel sheet is performed at a temperature of 1000° C. or higher, and a cooling rate in a temperature range of a temperature at which the externally oxidized layer is formed to 200° C. is controlled to be 100° C./sec or lower such that a cross-sectional area fraction of voids in the externally oxidized layer is 30% or lower. As a result, coating adhesion between the tension-insulation coating and the steel sheet is secured.

Patent Document 11 discloses a method of securing coating adhesion between a tension-insulation coating and a steel sheet. In this method, in a heat treatment process for forming an externally oxidized layer on a smoothed steel sheet surface of a grain-oriented electrical steel sheet, a heat treatment is performed under conditions of heat treatment temperature: 600° C. to 1150° C. and atmosphere dew point: −20° C. to 0° C. and annealing is performed at an atmosphere dew point of 5° C. to 60° C. in a cooling atmosphere such that a cross-sectional area fraction of metallic iron in the externally oxidized layer is 5% to 30%, As a result, coating adhesion between the tension-insulation coating and the steel sheet is secured.

However, sufficient adhesion between a tension-insulation coating and a steel sheet cannot be obtained with the techniques of the related art, and it may be difficult to sufficiently obtain the expected effect of reducing iron loss.

PRIOR ART DOCUMENT

Patent Document

[Patent Document 1] Japanese Unexamined Patent Application, First Publication No. S48-039338
[Patent Document 2] Japanese Unexamined Patent Application. First Publication No. H7-278670
[Patent Document 3] Japanese Unexamined Patent Application. First Publication No. H11-106827
[Patent Document 4] Japanese Unexamined Patent Application, First Publication No. H11-118750
[Patent Document 5] Japanese Unexamined Patent Application, First Publication No. 2003-268450
[Patent Document 6] Japanese Unexamined Patent Application. First Publication No. H7-278833
[Patent Document 7] Japanese Unexamined Patent Application. First Publication No. 2002-322566
[Patent Document 8] Japanese Unexamined Patent Application. First Publication No. 2002-348643
[Patent Document 9] Japanese Unexamined Patent Application. First Publication No. 2003-293149
[Patent Document 10] Japanese Unexamined Patent Application. First Publication No. 2002-363763
[Patent Document 11] Japanese Unexamined Patent Application, First Publication No. 2003-313644

Non-Patent Document

[Non-Patent Document 1] Iron and Steel. Vol. 77 (1991). No. 7, p. 1075

DISCLOSURE OF THE INVENTION

Problems to be Solved by the Invention

The present invention has been made in consideration of the technique of the related art, and an object thereof is to improve coating adhesion between a tension-insulation coating and a steel sheet surface in a grain-oriented electrical steel sheet not including a forsterite film. That is, an object of the present invention is to provide a grain-oriented electrical steel sheet having excellent coating adhesion between a tension-insulation coating and a steel sheet surface.

Means for Solving the Problem

The present inventors conducted a thorough investigation on a method for achieving the object. As a result, it was found that coating adhesion between a tension-insulation coating and a steel sheet surface can be improved by forming an amorphous oxide layer on the steel sheet surface and uniformizing (smoothing) morphology of the amorphous oxide layer.

The present invention has been made based on the above finding, and the scope thereof is as follows.

(1) According to one aspect of the present invention, there is provided a grain-oriented electrical steel sheet including: a steel sheet; and an amorphous oxide layer that is formed on the steel sheet, in which the steel sheet includes, as a chemical composition, by mass %, C: 0.085% or less. Si: 0.80% to 7.00%, Mn: 1.50% or less, acid-soluble Al: 0.065% or less. S: 0.013% or less. Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, and a NSIC value of a surface is 4.0% or more, the NSIC value being obtained by measuring an image clearness of the surface using an image clearness measuring device.

(2) In the grain-oriented electrical steel sheet according to (1), the steel sheet may include, as the chemical composition, by mass %, Cu: 0.01% to 0.80%.

(3) In the grain-oriented electrical steel sheet according to (1) or (2), the steel sheet may include, as the chemical composition, by mass %, at least one selected from the group consisting of N: 0.001% to 0.012%, P: 0.010% to 0.50%, Ni: 0.010% to 1.00%, Sn: 0.010% to 0.30%, and Sb: 0.010% to 0.30%.

Effects of the Invention

As described above, according to the aspect of the present invention, a grain-oriented electrical steel sheet having significantly high coating adhesion with a tension-insulation coating can be provided, the grain-oriented electrical steel sheet having a surface on which a forsterite film is not formed.

BRIEF DESCRIPTION OF THE DRAWINGS

FIG. 1 is a diagram showing a relationship between an area fraction of remained coating and an NSIC value.

EMBODIMENTS OF THE INVENTION

A grain-oriented electrical steel sheet according to an embodiment of the present invention (hereinafter, referred to as "electrical steel sheet according to the embodiment") includes:

a steel sheet; and an amorphous oxide layer that is formed on the steel sheet, in which the steel sheet includes, as a chemical composition, by mass %, C: 0.085% or less,
Si: 0.80% to 7.00%,
Mn: 1.50% or less,
acid-soluble Al: 0.065% or less,
S: 0.013% or less,
Cu: 0% to 0.80%,
N: 0% to 0.012%,
P: 0% to 0.50%,
Ni: 0% to 1.00%,
Sn: 0% to 0.30%,
Sb: 0% to 0.30%, and
a remainder of Fe and impurities, and a NSIC value (a value obtained by measuring an image clearness of a steel sheet surface using an image clearness measuring device [NSIC]) of a steel sheet surface is 4.0% or more, the NSIC value being obtained by measuring an image clearness of the steel sheet surface using an image clearness measuring device.

This electrical steel sheet is an grain-oriented electrical steel sheet not including a forsterite film, the electrical steel sheet using a slab including, by mass %, C: 0.085% or less, Si: 0.80% to 7.00%, Mn: 0.01% to 1.50%, acid-soluble Al: 0.01% to 0.065%, S: 0.003% to 0.013%, and a remainder of Fe and impurities as a material.

The grain-oriented electrical steel sheet according to the embodiment of the present invention (the electrical steel sheet according to the embodiment) will be described.

<Coating Adhesion>

The present inventors investigated a method of securing excellent coating adhesion in a grain-oriented electrical steel sheet not including a forsterite film (having a surface on which a forsterite film is not formed). As a result, the present inventors conceived of the following ideas: it is necessary to suppress stress concentration on an interface between a coating and a steel sheet surface; and to that end, it is important to form an amorphous oxide layer on a surface of the steel sheet not including a forsterite film (in particular, to form the amorphous oxide layer to be in direct contact with the surface of the steel sheet) and subsequently to uniformize (smooth) the morphology of the amorphous oxide layer. Based on these ideas, the present inventors conducted a thorough investigation. The steel sheet not including a forsterite film can be formed by removing the forsterite film after final annealing or by intentionally preventing the formation of forsterite. For example, by adjusting the composition of an annealing separator, the formation of forsterite can be intentionally prevented.

It is presumed that, as described above, by forming an amorphous oxide layer on a surface of the steel sheet not including a forsterite film and subsequently uniformizing (smoothing) the morphology of the amorphous oxide in the amorphous oxide layer (the morphology of the amorphous oxide layer), adhesion between a tension-insulation coating formed on the amorphous oxide layer and the steel sheet can be improved. However, the thickness of the amorphous oxide layer is extremely small at several nanometers, and thus it is extremely difficult to evaluate the uniformity (smoothness) of the morphology of the amorphous oxide layer.

As a result of the thorough investigation, the present inventors found that the uniformity (smoothness) of the morphology of the amorphous oxide layer having a thickness of several nanometers can be evaluated using an image clearness (measured value obtained using an image clearness measuring device [NSIC]) for evaluating the clearness of the steel sheet surface.

As a method for evaluating the clearness of the steel sheet surface, a PGD meter is widely known. However, it has been reported that the sensitivity of the PGD meter in a high-gloss region is low. On the other hand, it has been reported that the NSIC has high sensitivity in a high-gloss region and the measured value thereof matches well with the visual evaluation (refer to Non-Patent Document 1).

Accordingly, the present inventors thought that an NSIC value is preferable to a PGD value as an index for evaluating the high-gloss surface of the amorphous oxide layer having an extremely small thickness of several nanometers, and evaluated and regulated the amorphous oxide layer based on the NSIC value.

In the embodiment, a NSIC value of a coating surface, is a value obtained by measuring the image clearness (smoothness) using an image clearness measuring device (NSIC, manufactured by Suga Test Instruments Co., Ltd.).

Specifically, the NSIC value is obtained by disposing a slit plate on which a linear slit is formed between a measurement surface and a light source, irradiating the measurement surface with light from the light source through the slit of the slit plate, capturing an image of the measurement surface using an image capturing device, and performing calculation based on the linearity and a difference in luminosity of a slit line image (difference in luminosity between the slit line image and the background color of a region adjacent thereto) in the captured image. The NSIC value is a value calculated relative to 100 in a case where measurement valued of a surface of a black glass is 100.

That is, as the NSIC value increases, the morphology of the amorphous oxide having a thickness of several nanometers that coats the steel sheet surface is uniform (smooth).

The present inventors conducted an experiment described below to investigate a relationship between coating adhesion and the NSIC value of the surface of the grain-oriented electrical steel sheet including an amorphous oxide.

An annealing separator including alumina as a main component was applied to a decarburization annealed sheet as a material for the experiment having a thickness of 0.23 mm including 3.4% of Si, and final annealing was performed thereon for secondary recrystallization. As a result, a grain-oriented electrical steel sheet not including a forsterite film was prepared. A heat treatment was performed on the grain-oriented electrical steel sheet in an atmosphere including 25% of nitrogen and 75% of hydrogen and having a dew point of −30° C. to 5° C. for a soaking time of 10 seconds to form an amorphous oxide including silica as a main component on a steel sheet surface.

An NSIC value (image clearness) of the surface of the grain-oriented electrical steel sheet with the amorphous oxide layer was measured using an image clearness measuring device (manufactured by Suga Test Instruments Co., Ltd.).

Next, a coating solution including a phosphate, chromic acid, and colloidal silica as main components was applied to the surface of the grain-oriented electrical steel sheet including the amorphous oxide layer and was baked in a nitrogen atmosphere at 835° C. for 30 seconds to form a tension-insulation coating on the steel sheet surface. Coating adhesion between the tension-insulation coating and the steel sheet surface was investigated.

The coating adhesion was evaluated by collecting a test piece from the steel sheet on which the tension-insulation coating was formed, winding the test piece around a cylinder having a diameter of 20 mm (180° bending), and obtaining an area fraction of a portion of the tension-insulation coating (hereinafter, referred to as "area fraction of remained coating") remaining while adhering to the steel sheet without being peeled off from the steel sheet after the test piece was bent back. The area fraction of remained coating may be measured by visual inspection.

FIG. 1 shows a relationship between the area fraction of remained coating and the NSIC value.

It can be seen from FIG. 1 that, when the NSIC value is 4.0% or higher, the area fraction of remained coating is 80% or higher, and high coating adhesion can be secured. In addition, it can be seen that, when the NSIC value is 4.5% or higher, the area fraction of remained coating is 90% or higher, and higher coating adhesion can be secured, and it can be seen that, when the NSIC value is 5.0% or higher, the area fraction of remained coating is 95% or higher, and much higher coating adhesion can be secured.

In consideration of the results shown in FIG. 1, the electrical steel sheet according to the embodiment is regulated such that the electrical steel sheet includes: a steel sheet; and an amorphous oxide layer that is formed on the steel sheet, in which a NSIC value (a value obtained by measuring an image clearness of a steel sheet surface using an image clearness measuring device [NSIC]) of a surface (when an insulation coating is formed, a surface from which the insulation coating is removed) is 4.0% or more. The upper limit of the NSIC value is not necessarily regulated but does not exceed 100.

Here. "amorphous" refers to a solid in which atoms or molecules are disordered without forming an ordered space lattice. Specifically. "amorphous" refers to a state where only a halo is detected and a specific peak is not detected in X-ray diffraction.

The amorphous oxide layer is a coating consisting of a substantially amorphous oxide. Whether or not the coating includes an oxide can be verified by TEM or FT-IR.

The NSIC value can be measured using an image clearness measuring device (manufactured by Suga Test Instruments Co., Ltd.) under the above-described conditions. When the tension-insulation coating is formed on the amorphous oxide layer, the NSIC value may be measured after dipping a test piece collected from the grain oriented electrical steel sheet in an etchant of 20% sodium hydroxide at 80° C. for 20 minutes and selectively removing only the tension-insulation coating.

The amorphous oxide layer is preferably an externally oxidized layer, not an internally oxidized layer. In the internally oxidized amorphous oxide layer, a part of the amorphous oxide is inserted into an interface between the steel sheet and the amorphous oxide, and an aspect ratio representing a ratio between the length of the inserted portion in a depth direction and the length of a base of the inserted portion is 1.2 or higher. In the externally oxidized amorphous oxide layer, an aspect ratio is lower than 1.2.

When the internally oxidized amorphous oxide layer is formed instead of the externally oxidized amorphous oxide layer, the tension-insulation coating may peel off from the inserted portion.

Next, a component composition of the electrical steel sheet according to the embodiment will be described. Hereinafter. % relating to the component composition represents "mass %".

<Component Composition>

C: 0.085% or less C is an element that is effective for controlling a primary recrystallization structure but causes an increase in iron loss by magnetic aging. Therefore, during decarburization annealing before final annealing, it is necessary for the C content to be reduced to less than 0.010%.

When the C content is more than 0.085%, a long period of time is required for decarburization annealing, and the productivity deteriorates. Therefore, the C content is set to be 0.085% or less. The C content is preferably 0.070% or less and more preferably 0.050% or less.

The lower limit is not particularly limited and is preferably 0.050% or more from the viewpoint of stably controlling the primary recrystallization structure.

Si: 0.80% to 7.00% Si is an element that increases the electric resistance of the steel sheet and causes a decrease in iron loss. When the Si content is less than 0.80%, the effect of the addition cannot be sufficiently obtained. In addition, phase transformation occurs during secondary recrystallization annealing, secondary recrystallization cannot be accurately controlled, crystal orientation deteriorates, and magnetic characteristics deteriorate. Therefore, the Si content is set to be 0.80% or more. The Si content is preferably 2.50% or more and more preferably 3.00% or more.

On the other hand, when the Si content is more than 7.00%, the steel sheet becomes brittle, it is difficult to perform cold rolling, and cracking occurs during rolling. Therefore, the Si content is set to be 7.00% or less. The Si content is preferably 4.00% or less and more preferably 3.75% or less.

Mn: 1.50% or less,

When the Mn content is more than 1.50%, phase transformation occurs during secondary recrystallization annealing, and high magnetic flux density cannot be obtained. Therefore, the Mn content is set to be 1.50% or less. The Mn content is preferably 1.20% or less and more preferably 0.90% or less.

On the other hand. Mn is an austenite-forming element and increases the specific resistance of the steel sheet to contribute to a decrease in iron loss. When the Mn content is less than 0.01%, the effect of the addition cannot be sufficiently obtained, and the steel sheet becomes brittle during hot rolling. Therefore, the Mn content is 0.01% or more. The Mn content is preferably 0.05% or more and more preferably 0.10% or more.

Acid-Soluble Al: 0.065% or Less

When the Al content is more than 0.065%, coarse (Al, Si)N precipitates, and the precipitation of (Al,Si)N becomes non-uniform. As a result, a desired secondary recrystallization structure cannot be obtained, and the magnetic flux density decreases. Therefore, the acid-soluble Al content is set to be 0.065% or less. The Al content is preferably 0.055% or less and more preferably 0.045% or less. The Al content may be 0%.

On the other hand, the acid-soluble Al is an element that binds to N to form (Al,Si)N functioning as an inhibitor. Therefore, when the acid-soluble Al content in the slab used for manufacturing is less than 0.010%, a sufficient amount of (Al,Si)N is not formed, and secondary recrystallization is not stable. Therefore, the acid-soluble Al content in the slab used for manufacturing is preferably 0.010% or more, and Al may remain in the steel sheet. The acid-soluble Al content in the slab is more preferably 0.002% or more and still more preferably 0.030% or more.

S: 0.013% or less

When the S content is more than 0.013%, precipitation dispersion of MnS becomes non-uniform, a desired secondary recrystallization structure cannot be obtained, and the magnetic flux density decreases. Therefore, the S content is 0.013% or less. The S content is preferably 0.012% or less and more preferably 0.011% or less.

On the other hand, S is an element that binds to Mn to form MnS functioning as an inhibitor. Therefore, the S content in the slab used for manufacturing is preferably 0.003% or more, and S may remain in the steel sheet. The S content in the slab used for manufacturing is more preferably 0.005% or more and still more preferably 0.008% or more.

In order to improve various characteristics, the electrical steel sheet according to the embodiment may include, in addition to the above-described elements. (a) Cu: 0.01% to 0.80% and/or (b) at least one selected from the group consisting of N: 0.001% to 0.012%, P: 0.50% or less. Ni: 1.00% or less. Sn: 0.30% or less, and Sb: 0.30% or less. However, since it is not necessary that the electrical steel sheet includes these elements, the lower limits of the contents thereof are 0%, (a) Element Cu: 0% to 0.80%

Cu is an element that binds to S to form a precipitate functioning as an inhibitor. When the Cu content is less than 0.01%, the effect is not sufficiently exhibited. Therefore, the Cu content is preferably 0.01% or more. The Cu content is more preferably 0.04% or more.

On the other hand, when the Cu content is more than 0.80%, dispersion of precipitates becomes non-uniform, and the effect of reducing iron loss is saturated. Therefore, the Cu content is preferably 0.80% or less. The Cu content is more preferably 0.60% or less.

(b) Group Elements

N: 0% to 0.0120%

N is an element that binds to Al to form AlN functioning as an inhibitor.

When the N content is less than 0.001%, formation of AlN is not sufficient. Therefore, the N content is preferably 0.001% or more. The N content is more preferably 0.006% or more. On the other hand. N is also an element that causes forming blisters (voids) in the steel sheet during cold rolling. When the N content is more than 0.0120%, blisters (voids) may be formed in the steel sheet during cold rolling. Therefore, the N content is preferably 0.012% or less. The N content is more preferably 0.009% or less.

P: 0% to 0.50%

P is an element that increases the specific resistance of the steel sheet to contribute to a decrease in iron loss. From the viewpoint of reliably obtaining the effect of the addition, the P content is preferably 0.01% or more.

On the other hand, when the P content is more than 0.50%, rollability deteriorates. Therefore, the P content is preferably 0.50% or less. The P content is more preferably 0.35% or less. The lower limit of the P content may be 0%, but when the P content is reduced to 0.0005%, the manufacturing costs significantly increase. Therefore, the lower limit of the P content in the steel sheet is substantially 0.0005%, Ni: 0% to 1.00%

Ni is an element that increases the specific resistance of the steel sheet to contribute to a decrease in iron loss and controls the metallographic structure of the hot-rolled steel sheet to contribute to improvement of magnetic characteristics. The lower limit may be 0%, but from the viewpoint of reliably obtaining the effect of the addition, the Ni content is preferably 0.01% or more.

On the other hand, when the Ni content is more than 1.00%, secondary recrystallization progresses unstably, and magnetic characteristics deteriorate. Therefore, the Ni content is preferably 1.00% or less. The Ni content is more preferably 0.35% or less.

Sn: 0% to 0.30%

Sb: 0% to 0.30%

Sn and Sb are elements that segregate in a grain boundary and have function to prevent Al from being oxidized by water emitted from the annealing separator during final annealing (due to this oxidation, the inhibitor intensity varies depending on coil positions, and magnetic characteristics vary). The lower limit may be 0%, but from the viewpoint of reliably obtaining the effect of the addition, the content of any of the elements is preferably 0.01% or more.

On the other hand, when the content of any of the elements is more than 0.30%, secondary recrystallization becomes unstable, and magnetic characteristics deteriorate. Therefore, the content of any of Sn and Sb is preferably 0.30% or less. The content of any of Sn and Sb is more preferably 0.25% or less.

The remainder in the electrical steel sheet according to the embodiment other than the above-described elements includes Fe and impurities. The impurities are elements that are unavoidably incorporated from steel raw materials and/or in the steelmaking process and are allowable within a range where the characteristics of the electrical steel sheet according to the embodiment are not inhibited.

The electrical steel sheet having the above-described chemical composition can be manufactured using a slab including, for example, as a chemical composition, by mass %, C: 0.085% or less. Si: 0.80% to 7.00%, Mn: 0.01% to 1.50%, acid-soluble Al: 0.01% to 0.065%, S: 0.003% to 0.013%, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities.

Next, a preferable method of manufacturing the electrical steel sheet according to the embodiment will be described.

A slab including predetermined components that are melted and cast using a typical method is provided for typical hot rolling to form a hot-rolled steel sheet, and the hot-rolled steel sheet is coiled in a coil shape. Next, after performing hot-band annealing on this hot-rolled steel sheet, cold rolling is performed once or cold rolling is performed multiple times while performing intermediate annealing therebetween. As a result, a steel sheet having the same thickness as that of a final product is obtained. Next, decarburization annealing is performed on the cold-rolled steel sheet.

It is preferable that decarburization annealing is performed in a wet hydrogen atmosphere. By performing decarburization annealing in the above-described atmosphere, the C content in the steel sheet is reduced even in a region where magnetic aging deterioration of the steel sheet as a product does not occur, and the metallographic structure can be primarily recrystallized. This primary recrystallization is a preparation for the next secondary recrystallization.

After decarburization annealing, the steel sheet is annealed in an ammonia atmosphere to form AlN as an inhibitor in the steel sheet.

Next, final annealing is performed at a temperature of 1100° C. or higher. Final annealing may be performed on the steel sheet in the form of a coil. In this case, final annealing is performed after applying an annealing separator including $Al_2O_3$ as a main component to the steel sheet surface in order to prevent seizure of the steel sheet.

After final annealing, the redundant annealing separator is cleaned with water using a scrubber to be removed and controls the surface state of the steel sheet. If the redundant annealing separator is removed, it is preferable that cleaning with water is performed in addition to performing a treatment using a scrubber.

It is preferable that an abrasive material formed of SiC is used as the scrubber and the abrasive grit size thereof 100 to 500 (P100 to P500 in JIS R6010).

When the abrasive grit size is less than 100, the steel sheet surface is excessively cut and thus, the surface activity increases. As a result, an iron oxide or the like is likely to be formed, and coating adhesion deteriorates. Therefore, it is not preferable that the abrasive grit size is less than 100. On the other hand, when the abrasive grit size is more than 500, the annealing separator cannot be sufficiently removed, and coating adhesion after the formation of the insulation coating is low. Therefore, it is not preferable that the abrasive grit size is more than 500.

Next, the steel sheet is annealed in a mixed atmosphere of hydrogen and nitrogen to form an amorphous oxide layer on the steel sheet surface. An oxygen partial pressure ($P_{H2O}/P_{H2}$) during annealing for forming the amorphous oxide layer is preferably 0.005 or lower and more preferably 0.001 or lower. The holding temperature is preferably 600° C. to 1150° C. and more preferably 700° C. to 900° C.

When the oxygen partial pressure ($P_{H2O}/P_{H2}$) is higher than 0.005, an iron oxide other than the amorphous oxide layer is formed, and coating adhesion deteriorates. In addition, when the holding temperature is lower than 600° C. the amorphous oxide is not likely to be sufficiently formed. In addition, it is not preferable that the holding temperature is higher than 1150° C. because a facility load is high.

The amorphous oxide layer is preferably an externally oxidized layer, not to be an internally oxidized layer. The uniformity (smoothness) of the morphology of the externally oxidized amorphous oxide layer having an aspect ratio of lower than 1.2 can be achieved by controlling the oxygen partial pressure to be 0.005 or lower during cooling of the annealing.

As a result, the grain-oriented electrical steel sheet including the amorphous oxide layer having the excellent coating adhesion with the tension-insulation coating can be obtained.

EXAMPLES

Next, examples of the present invention will be described. However, the conditions are merely exemplary examples and confirm the operability and the effects of the present invention, and the present invention is not limited to these condition examples. The present invention can adopt various conditions within a range not departing from the scope of the present invention as long as the object of the present invention can be achieved under the conditions.

Example 1

Each of silicon steel slabs (Steels No. A to F) having component compositions shown in Table 1 was heated to 1100° C. and was hot-rolled to form a hot-rolled steel sheet having a thickness of 2.6 mm.

After annealing the hot-rolled steel sheet at 1100° C. cold rolling was performed once or cold rolling was performed multiple times while performing intermediate annealing therebetween. As a result, a cold-rolled steel sheet having a final thickness of 0.23 mm was obtained. Next, decarburization annealing and nitriding annealing were performed on the cold-rolled steel sheet.

Next, a water slurry of an annealing separator including alumina as a main component was applied, and final annealing was performed at 1200° C. for 20 hours to complete secondary recrystallization. As a result, a grain-oriented electrical steel sheet having specular glossiness not including a forsterite film was manufactured. Before final annealing, the removal of the annealing separator and the control of the surface state were performed using a scrubber having an abrasive grit size shown in Table 2. When components of the steel sheet after final annealing were analyzed, the results are as shown in Table 1-2.

Soaking was performed on the steel sheet at 800° C. for 30 seconds in an atmosphere including 25% of nitrogen and 75% of hydrogen and having an oxygen partial pressure shown in Table 2. Next, the steel sheet was cooled to a room temperature in an atmosphere including 25% of nitrogen and 75% of hydrogen and having an oxygen partial pressure shown in Table 2. When the holding temperature of annealing was 600° C. or higher, a coating was formed on the steel sheet surface.

Whether or not the coating formed on the steel sheet surface was an amorphous oxide layer was verified by X-ray diffraction and TEM. In addition. FT-IR was also used for the verification.

Specifically, with a combination of each of Steels No. on which the coating was formed and manufacturing conditions No., a cross-section of the steel sheet was processed by focused ion beam (FIB), and a 10 μm×10 μm range was observed with a transmission electron microscope (TEM), and it was verified that the coating was formed of $SiO_2$.

In addition, when the surface was analyzed by Fourier transform infrared spectroscopy (FT-IR), a peak was present at a wavenumber position of 1250 ($cm^{-1}$). Since this peak was derived from $SiO_2$, it was also able to verify that the coating was formed of $SiO_2$ from this peak.

In addition, when X-ray diffraction was performed on the steel sheet including the coating, only halo was detected except for a peak of base metal, and a specific peak was not detected.

TABLE 1-1

| | Chemical Composition (mass %) | | | | | | | | | | |
|---|---|---|---|---|---|---|---|---|---|---|---|
| Steel No. | C | Si | Mn | Al | S | Cu | N | P | Ni | Sb | Sn |
| A | 0.083 | 1.20 | 0.01 | 0.015 | 0.005 | 0.01 | 0 | 0 | 0 | 0 | 0 |
| B | 0.072 | 3.75 | 1.01 | 0.020 | 0.013 | 0.02 | 0.008 | 0 | 0 | 0 | 0 |
| C | 0.068 | 2.50 | 0.50 | 0.030 | 0.002 | 0.24 | 0.010 | 0.20 | 0 | 0 | 0 |
| D | 0.055 | 3.79 | 1.50 | 0.026 | 0.003 | 0.04 | 0.012 | 0.30 | 0.80 | 0 | 0 |
| E | 0.081 | 6.50 | 0.20 | 0.050 | 0.0008 | 0.03 | 0.012 | 0.40 | 0.90 | 0.20 | 0 |
| F | 0.072 | 7.00 | 0.80 | 0.065 | 0.0007 | 0.07 | 0.012 | 0.50 | 1.00 | 0.30 | 0.30 |

TABLE 1-2

| | Chemical Composition (mass %) | | | | | | | | | | |
|---|---|---|---|---|---|---|---|---|---|---|---|
| Steel No. | C | Si | Mn | Al | S | Cu | N | P | Ni | Sb | Sn |
| A | 0.008 | 0.80 | 0.01 | 0.010 | 0.002 | 0 | 0 | 0 | 0 | 0 | 0 |
| B | 0.010 | 3.70 | 0.01 | 0.012 | 0.008 | 0 | 0.000 | 0 | 0 | 0 | 0 |
| C | 0.003 | 2.41 | 0.40 | 0.021 | 0.001 | 0.24 | 0.010 | 0.20 | 0 | 0 | 0 |
| D | 0.003 | 3.68 | 1.31 | 0.019 | 0.002 | 0.04 | 0.012 | 0.30 | 0.80 | 0 | 0 |
| E | 0.001 | 6.10 | 0.18 | 0.042 | 0.0006 | 0.03 | 0.012 | 0.40 | 0.90 | 0.20 | 0 |
| F | 0.008 | 6.88 | 0.70 | 0.054 | 0.0006 | 0.07 | 0.012 | 0.50 | 1.00 | 0.30 | 0.30 |

That is, all the formed films were the amorphous oxide layers.

Next, in order to evaluate adhesion with the tension-insulation coating, a solution for forming a tension-insulation coating including aluminum phosphate, chromic acid, and colloidal silica was applied to the grain-oriented electrical steel sheet on which the amorphous oxide layer was formed, and was baked at 850° C. for 30 seconds. As a result, the grain-oriented electrical steel sheet with the tension-insulation coating was manufactured.

A test piece collected from the manufactured grain-oriented electrical steel sheet with the tension-insulation coating was wound around a cylinder having a diameter of 20 mm (180° bending), and was bent back. At this time, an area fraction of remained coating was obtained, and coating adhesion with the tension-insulation coating was evaluated based on the area fraction of remained coating. In the evaluation of the coating adhesion with the tension-insulation coating, whether or not the tension-insulation coating was peeled off was determined by visual inspection. A case where the tension-insulation coating was not peeled off from the steel sheet and the area fraction of remained coating was 90% or higher was evaluated as "GOOD", and a case where the area fraction of remained coating was 80% or higher and lower than 90% was evaluated as "OK", and a case where the area fraction of remained coating was lower than 80% was evaluated as "NG".

Next, in order to measure a NSIC value of the grain-oriented electrical steel sheet with the amorphous oxide layer, a test piece collected from the grain oriented electrical steel sheet with the tension-insulation coating was dipped in an etchant of 20% sodium hydroxide at 80° C. for 20 minutes, and only the tension-insulation coating was selectively removed.

An NSIC value of the surface of the grain-oriented electrical steel sheet with the amorphous oxide layer from which the tension-insulation coating was selectively removed was measured using an image clearness measuring device (manufactured by Suga Test Instruments Co., Ltd.). Specifically, a slit plate on which a linear slit is formed was disposed between a measurement surface and a light source, the measurement surface was irradiated with light from the light source through the slit of the slit plate, an image of the measurement surface was captured using an image capturing device, and calculation was performed based on the linearity and a difference in luminosity of a slit line image (difference in luminosity between the slit line image and the background color of a region adjacent thereto) in the captured image. The NSIC value was calculated relative to 100 in a case where measurement valued of a surface of a black glass is 100. Table 2 shows the NSIC values and the results of the evaluation of the coating adhesion with tension-insulation coating.

TABLE 2

| | Manufacturing Conditions | | | | | | | | |
|---|---|---|---|---|---|---|---|---|---|
| | | Annealing | | | Evaluation of Characteristics | | | | |
| | | | | Oxygen | Steel No. A | | Steel No. B | | Steel No. C |
| | | | Holding | Partial | | | | | |
| Manufacturing Condition No. | Scrubber Abrasive Grit Size | Oxygen Partial Pressure | Temperature (° C.) | Pressure during Cooling | NSIC Value (%) | Coating Adhesion | NSIC Value (%) | Coating Adhesion | NSIC Value (%) |
| 1 | 80 | 0.005 | 600 | 0.005 | 2.9 | NG | 2.8 | NG | 2.7 |
| 2 | 600 | 0.001 | 800 | 0.001 | 3.2 | NG | 3.1 | NG | 3.3 |
| 3 | 80 | 0.008 | 1150 | 0.008 | 3.4 | NG | 3.3 | NG | 3.4 |
| 4 | 80 | 0.007 | 850 | 0.007 | 3.6 | NG | 3.1 | NG | 3.6 |
| 5 | 80 | 0.004 | 500 | 0.004 | 2.8 | NG | 3.8 | NG | 3.8 |
| 6 | 80 | 0.0008 | 550 | 0.0008 | 3.9 | NG | 3.7 | NG | 3.9 |
| 7 | 100 | 0.001 | 500 | 0.001 | 2.8 | NG | 2.7 | NG | 2.6 |
| 8 | 280 | 0.010 | 450 | 0.010 | 3.1 | NG | 3.4 | NG | 2.8 |
| 9 | 420 | 0.006 | 830 | 0.006 | 3.4 | NG | 3.5 | NG | 3.2 |
| 10 | 500 | 0.009 | 680 | 0.009 | 3.6 | NG | 3.7 | NG | 3.4 |
| 11 | 200 | 0.004 | 600 | 0.004 | 4.0 | OK | 4.0 | OK | 4.0 |
| 12 | 240 | 0.002 | 640 | 0.002 | 4.1 | OK | 4.2 | OK | 4.4 |
| 13 | 400 | 0.003 | 690 | 0.003 | 4.5 | OK | 4.5 | OK | 4.5 |
| 14 | 100 | 0.0009 | 835 | 0.0009 | 4.9 | OK | 4.8 | OK | 4.6 |
| 15 | 240 | 0.0005 | 850 | 0.0005 | 5.0 | GOOD | 5.0 | GOOD | 5.0 |
| 16 | 400 | 0.0003 | 870 | 0.0003 | 5.5 | GOOD | 5.1 | GOOD | 5.4 |
| 17 | 500 | 0.0004 | 880 | 0.0004 | 5.6 | GOOD | 5.6 | GOOD | 5.8 |

| | Evaluation of Characteristics | | | | | | | |
|---|---|---|---|---|---|---|---|---|
| | Steel No. C | Steel No. D | | Steel No. E | | Steel No. F | | |
| Manufacturing Condition No. | Coating Adhesion | NSIC Value (%) | Coating Adhesion | NSIC Value (%) | Coating Adhesion | NSIC Value (%) | Coating Adhesion | Note |
| 1 | NG | 2.8 | NG | 2.6 | NG | 2.7 | NG | Comparative Example |
| 2 | NG | 3.2 | NG | 3.1 | NG | 3.2 | NG | Comparative Example |
| 3 | NG | 3.5 | NG | 3.3 | NG | 3.3 | NG | Comparative Example |
| 4 | NG | 3.5 | NG | 3.1 | NG | 3.4 | NG | Comparative Example |

TABLE 2-continued

| | | | | | | | | |
|---|---|---|---|---|---|---|---|---|
| 5 | NG | 3.6 | NG | 3.8 | NG | 3.8 | NG | Comparative Example |
| 6 | NG | 3.4 | NG | 3.9 | NG | 3.2 | NG | Comparative Example |
| 7 | NG | 2.8 | NG | 2.7 | NG | 2.6 | NG | Comparative Example |
| 8 | NG | 3.1 | NG | 3.2 | NG | 3.1 | NG | Comparative Example |
| 9 | NG | 3.3 | NG | 3.4 | NG | 3.3 | NG | Comparative Example |
| 10 | NG | 3.5 | NG | 3.6 | NG | 3.5 | NG | Comparative Example |
| 11 | OK | 4.0 | OK | 4.0 | OK | 4.0 | OK | Example |
| 12 | OK | 4.3 | OK | 4.1 | OK | 4.2 | OK | Example |
| 13 | OK | 4.5 | OK | 4.5 | OK | 4.5 | OK | Example |
| 14 | OK | 4.8 | OK | 4.7 | OK | 4.6 | OK | Example |
| 15 | GOOD | 5.0 | GOOD | 5.0 | GOOD | 5.0 | GOOD | Example |
| 16 | GOOD | 5.3 | GOOD | 5.1 | GOOD | 5.2 | GOOD | Example |
| 17 | GOOD | 5.1 | GOOD | 5.6 | GOOD | 5.4 | GOOD | Example |

It can be seen from Table 2 that, when the NSIC value is 4.0%, the coating adhesion is excellent.

INDUSTRIAL APPLICABILITY

As described above, according to the present invention, a grain-oriented electrical steel sheet not including a forsterite film having excellent coating adhesion with a tension-insulation coating can be provided, the grain-oriented electrical steel sheet being a grain-oriented electrical steel sheet with an amorphous oxide layer. Accordingly the present invention is highly applicable to the industries of manufacturing and processing electrical steel sheets.

The invention claimed is:

1. A grain-oriented electrical steel sheet comprising:

a steel sheet; and an amorphous oxide layer that is formed on the steel sheet, wherein the steel sheet includes, as a chemical composition, by mass %, C: 0.085% or less, Si: 0.80% to 7.00%, Mn: 1.50% or less, acid-soluble Al: 0.065% or less, S: 0.013% or less, Cu: 0% to 0.80%, N: 0% to 0.012%, P: 0% to 0.50%, Ni: 0% to 1.00%, Sn: 0% to 0.30%, Sb: 0% to 0.30%, and a remainder of Fe and impurities, and a NSIC value of a surface is 4.0% or more, the NSIC value being obtained by measuring an image clearness of the surface using an image clearness measuring device.

2. The grain-oriented electrical steel sheet according to claim 1, wherein the steel sheet includes, as the chemical composition, by mass %, Cu: 0.01% to 0.80%.

3. The grain-oriented electrical steel sheet according to claim 1, wherein the steel sheet includes, as the chemical composition, by mass %, at least one selected from the group consisting of N: 0.001% to 0.012%, P: 0.010% to 0.50%, Ni: 0.010% to 1.00%, Sn: 0.010% to 0.30%, and Sb: 0.010% to 0.30%.

4. The grain-oriented electrical steel sheet according to claim 2, wherein the steel sheet includes, as the chemical composition, by mass %, at least one selected from the group consisting of N: 0.001% to 0.012%, P: 0.010% to 0.50%, Ni: 0.010% to 1.00%, Sn: 0.010% to 0.30%, and Sb: 0.010% to 0.30%.

* * * * *